US010132060B2

(12) United States Patent
Forcash et al.

(10) Patent No.: US 10,132,060 B2
(45) Date of Patent: Nov. 20, 2018

(54) IMPLEMENT ORIENTATION BY IMAGE PROCESSING

(71) Applicant: Caterpillar Inc., Peoria, IL (US)

(72) Inventors: Joseph Edward Forcash, Zelienople, PA (US); Lawrence Andrew Mianzo, Pittsburgh, PA (US); Paul Edmund Rybski, Pittsburgh, PA (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/443,479

(22) Filed: Feb. 27, 2017

(65) Prior Publication Data

US 2018/0245316 A1 Aug. 30, 2018

(51) Int. Cl.

| | |
|---|---|
| ***E02F 9/26*** | (2006.01) |
| ***E02F 3/28*** | (2006.01) |
| ***E02F 1/00*** | (2006.01) |

(52) U.S. Cl.

CPC ..... *E02F 9/265* (2013.01); *E02F 1/00* (2013.01); *E02F 3/283* (2013.01)

(58) Field of Classification Search

CPC . E02F 9/265; E02F 3/847; E02F 9/261; E02F 3/435; E02F 9/437; B23K 9/32; A01B 63/002

See application file for complete search history.

(56) References Cited

U.S. PATENT DOCUMENTS

| | | | | |
|---|---|---|---|---|
| 8,412,418 | B2 | 4/2013 | Kumagai et al. | |
| 9,139,977 | B2 | 9/2015 | McCain et al. | |
| 9,790,666 | B2 * | 10/2017 | Kawamoto | E02F 9/261 |
| 2010/0201803 | A1 * | 8/2010 | Melikian | B23K 9/32 348/90 |
| 2011/0169949 | A1 * | 7/2011 | McCain | E02F 3/847 348/137 |
| 2015/0225923 | A1 * | 8/2015 | Wallace | E02F 3/847 701/50 |
| 2016/0251836 | A1 * | 9/2016 | Baba | E02F 3/435 701/50 |
| 2017/0089033 | A1 * | 3/2017 | Matsuyama | E02F 3/437 |
| 2017/0112043 | A1 * | 4/2017 | Nair | A01B 63/002 |

FOREIGN PATENT DOCUMENTS

| | | | |
|---|---|---|---|
| CA | 2828145 | A1 | 9/2005 |
| WO | 2016013691 | A1 | 1/2016 |

* cited by examiner

*Primary Examiner* — Yuri Kan

(74) *Attorney, Agent, or Firm* — Miller, Matthias & Hull

(57) ABSTRACT

A system for monitoring an implement of a work machine is provided. The system may include one or more image sensors mounted on the work machine configured to capture one or more images of a field of view associated with the implement, and an implement controller in electrical communication with the image sensors. The implement controller may be configured to receive the images from the image sensors, identify one or more interactive targets within the images, select one of the interactive targets based on proximity, and align the implement to the selected interactive target.

20 Claims, 5 Drawing Sheets

IMPLEMENT ORIENTATION BY IMAGE PROCESSING

TECHNICAL FIELD

The present disclosure relates generally to monitoring systems, and more particularly, to image-based recognition techniques for monitoring and guiding implement control in work machines.

BACKGROUND

Various construction, mining or farming machines, such as wheel loaders, excavators, dozers, motor graders, wheel tractor scrapers, and other off-highway work machines employ implements or other work tool attachments designed to perform different tasks within the given worksite. Moreover, work machines and the associated implements are typically operated or controlled manually by an operator to perform the desired task. Common tasks involve moving or adjusting a position of the attached implement to interact with some target object within the worksite. For instance, a bucket implement may be controlled to cut and carry materials or other loads from one area of a worksite to another, while a fork implement may be controlled to lift and transport pallets or other comparable loads. Such manual operation may be adequate under many circumstances. However, the limited view of the implement and target objects from the operator cab poses a problem that has yet to be fully resolved.

One conventional solution to a related problem is disclosed in U.S. Pat. No. 9,139,977 ("McCain"). McCain is directed to a system for determining the orientation of a machine implement which employs a camera mounted on the machine to visually track a marker positioned directly on the implement. The marker is arranged on the implement in a manner which enables the camera and the monitoring system to determine the orientation of the implement relative to the machine. Although McCain may somewhat aid the operator in determining the position of the implement, McCain does not track, identify or otherwise assist the operator with respect to a target object with which the implement must interact. For instance, the system in McCain would not be helpful in situations where a target object or load is not clearly visible by the operator from the operator cab of the work machine.

In view of the foregoing disadvantages associated with conventional techniques for controlling or operating machine implements, a need exists for a solution which is not only capable of effectively tracking a position or orientation of the implement, but also capable of tracking a position of a target object with which the implement should interact. In particular, there is a need for a monitoring system that can track the implement position relative to interactive target objects, and use that information to help align the implement to the target object via autonomous, semi-autonomous, or manual controls. There is also a need to implement such a system onto a work machine in a simplified and non-intrusive manner. It should be appreciated that the solution of any particular problem is not a limitation on the scope of this disclosure or of the attached claims except to the extent expressly noted.

SUMMARY OF THE DISCLOSURE

In one aspect of the present disclosure, a system for monitoring an implement of a work machine is provided.

The system may include one or more image sensors mounted on the work machine configured to capture one or more images of a field of view associated with the implement, and an implement controller in electrical communication with the image sensors. The implement controller may be configured to receive the images from the image sensors, identify one or more interactive targets within the images, select one of the interactive targets based on proximity, and align the implement to the selected interactive target.

In another aspect of the present disclosure, a work machine is provided. The work machine may include a machine frame supported by traction devices, an operator cab coupled to the machine frame, an implement movably coupled to the operator cab, one or more image sensors mounted on the operator cab configured to capture one or more images of a field of view associated with the implement, and a controller in electrical communication with the image sensors and the implement. The controller may be configured to receive the images from the image sensors, identify one or more interactive targets within the images, select one of the interactive targets based on proximity, and align the implement to the selected interactive target.

In yet another aspect of the present disclosure, a method of monitoring an implement of a work machine is provided. The method may include capturing one or more images of a field of view associated with the implement from one or more image sensors; receiving the images from the image sensors; identifying one or more interactive targets within the images; selecting one of the interactive targets based on proximity; and aligning the implement to the selected interactive target.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
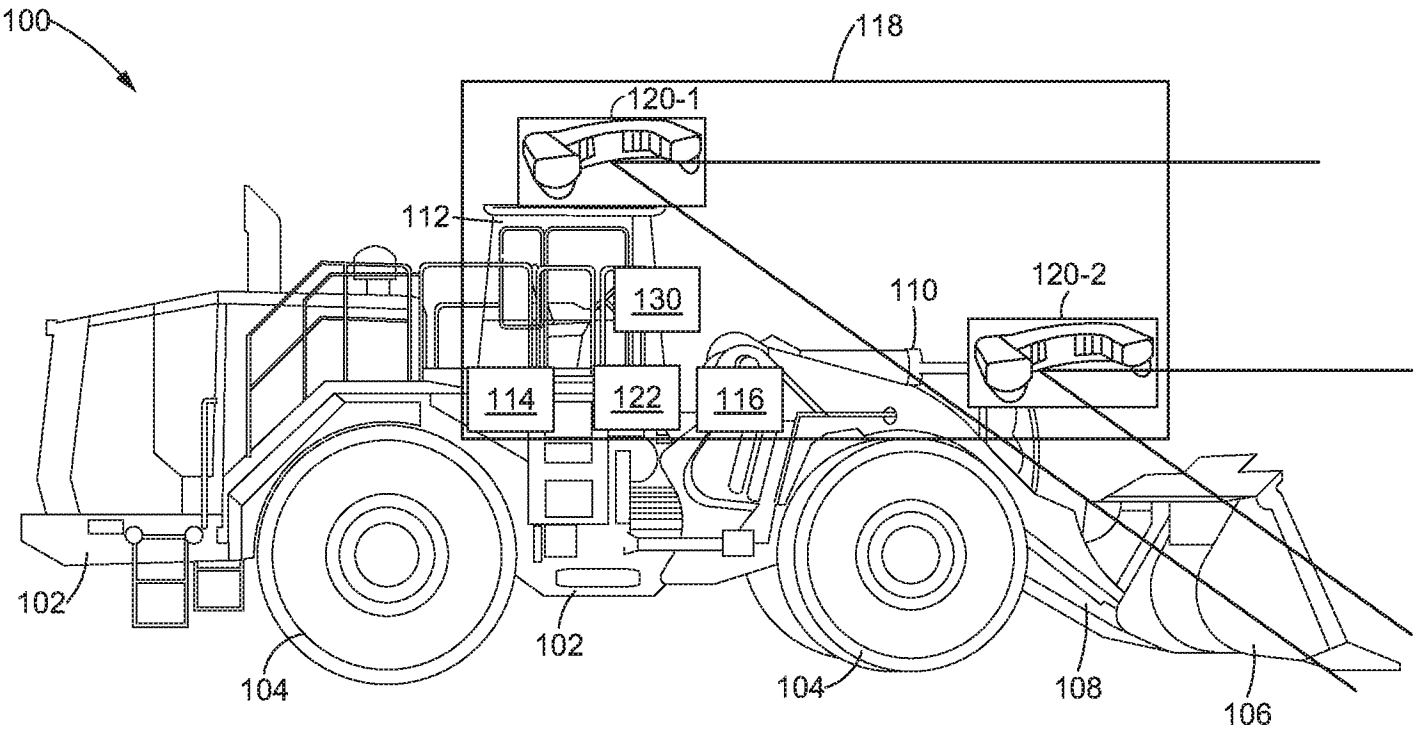
FIG. 1 is a pictorial illustration of one exemplary embodiment of a work machine having an implement control system of the present disclosure.

Referring now to FIG. 1, one exemplary embodiment of a work machine 100 is provided. In the particular embodiment of FIG. 1, the work machine 100 is provided in the form of a wheel loader having, for example, a machine frame 102 that is movably supported by one or more traction devices 104, such as wheels, tracks, or the like. The machine frame 102 may further support an implement 106, such as a bucket, fork tool, or the like, that is movable relative to the machine frame 102 via an arrangement of linkages 108 and actuators 110. The machine frame 102 may further support an operator cab 112 from which an operator may control and operate the implement 106. Although depicted as a wheel loader, it will be understood that the work machine 100 may encompass excavators, dozers, motor graders, wheel tractor scrapers, or any other type of vehicle or machine with an implement attachment that is configured to perform operations common in industries related to construction, mining, farming, and the like.

In the embodiment shown in FIG. 1, the work machine 100 may further include one or more machine sensors 114, and one or more implement sensors 116. The machine sensors 114 may be configured to signal or track a geographical position or location of the work machine 100 relative to a given worksite. For instance, the machine sensors 114 may track the location of the work machine 100 using a Global Positioning System (GPS), a Global Navigation Satellite System (GNSS), or the like. The implement sensors 116 may be configured to track the spatial pose, such as the position and/or orientation, of the implement 106 relative to the work machine 100 or machine frame 102. For example, the implement sensors 116 may incorporate gauges, encoders, proximity sensors, or any other suitable sensing mechanisms that are coupled to the implement 106, the linkages 108 and/or the actuators 110 and capable of collecting feedback corresponding to the spatial pose of the implement 106.

Figure 2:
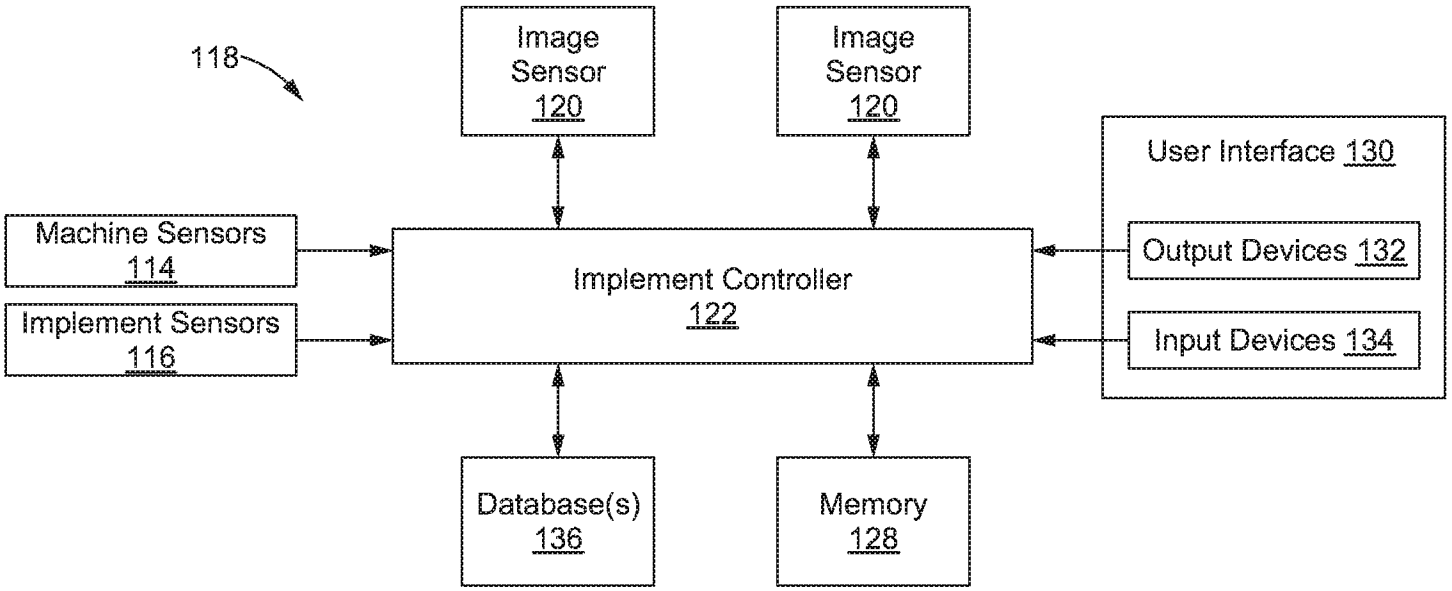
FIG. 2 is a diagrammatic view of one exemplary embodiment of an implement control system of the present disclosure.

Still referring to FIG. 1, and with further reference to FIG. 2, the work machine 100 may also include an implement control system 118. The implement control system 118 may generally include one or more image sensors 120 mounted on the work machine 100, and an implement controller 122 in electrical communication with the image sensors 120. Specifically, the system 118 may provide a first image sensor 120-1 positioned at a first height relative to the work machine 100 configured to capture a first field of view of the implement 106, as well as a second image sensor 120-2 positioned at a second height relative to the work machine 100 configured to capture a second field of view of the implement 106. For instance, the first image sensor 120-1 may be mounted on the operator cab 112, and aimed to capture images at least partially coinciding with a range of motion of the implement 106 from the first height, while the second image sensor 120-2 may be mounted on the machine frame 102, and aimed to capture images at least partially coinciding with the range of motion of the implement 106 from the second height.

Figure 3:
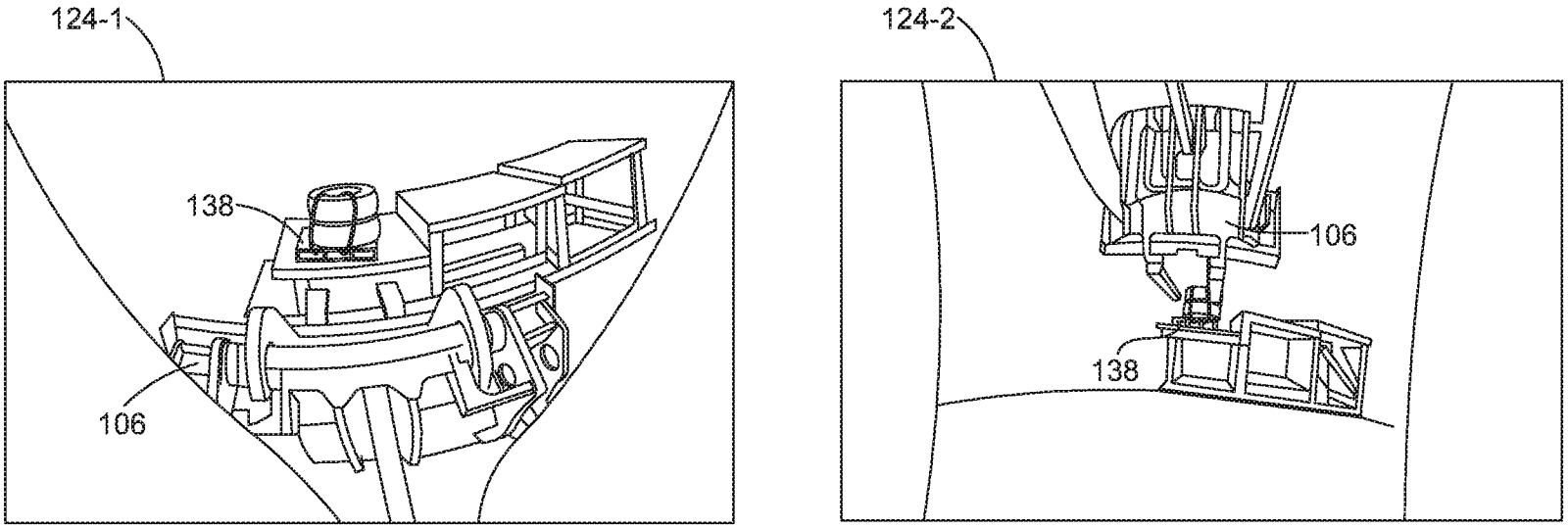
FIG. 3 is a pictorial illustration of exemplary images captured by image sensors of the present disclosure.

Turning to FIG. 3, for example, the first image sensor 120-1 may be configured to capture the first image 124-1 shown, while the second image sensor 120-2 may be configured to capture the second image 124-2 shown. As further shown in FIGS. 4 and 5, each of the image sensors 120 may also be positioned in a manner configured to capture one or more interactive targets 126, or one or more target objects with which the given implement 106 is likely to interact with. Each of the image sensors 120 may implement a digital camera, or any other suitable image capturing device configured to capture digital photos, videos, or combinations thereof. Moreover, the image sensors 120 may capture images 124 in two-dimensional format or three-dimensional format. Furthermore, the image sensors 120 may be adapted for capturing images 124 based on the visible spectral range, infrared spectral range, or the like. In general, the image sensors 120 may incorporate any image-based processing and/or recognition scheme capable of sufficiently discerning the implement 106 and any existing interactive targets 126 from within the captured images 124.

Referring back to FIGS. 1 and 2, the implement controller 122 may be implemented using any one or more of a processor, a microprocessor, a microcontroller, or any other suitable means for executing instructions stored within a memory 128 associated therewith. The memory 128 may be provided on-board the controller 122, external to the controller 122, or otherwise in communication therewith, and include non-transitory computer-readable medium or memory, such as a disc drive, flash drive, optical memory, read-only memory (ROM), or the like. Furthermore, the instructions or code stored within the memory 128 may preprogram or configure the controller 122 to guide the operator in controlling and operating the implement 106. In general, the instructions or code may configure the controller 122 to receive the captured images 124 from the image sensors 120, identify one or more interactive targets 126 within the images 124, select one or more of the interactive targets 126 based on proximity, and align the implement 106 to the selected interactive targets 126.

As shown in FIG. 2, the implement control system 118 may additionally include a user interface 130 configured to enable an operator to interact with the implement control system 118 and the implement 106. Specifically, the user interface 130 may be disposed within the operator cab 112, and include output devices 132, such as display screens or other devices configured to output information to an operator, as well as input devices 134, such as touchscreens, touchpads, capacitive keys, buttons, dials, switches, or other devices capable of receiving operator input. Moreover, the controller 122 may employ the output devices 132 of the user interface 130 to communicate with or to guide the operator in controlling the implement 106 based on image processing of the captured images 124. The controller 122 may also be able to track the position of the work machine 100 and/or the spatial pose of the implement 106 based at least partially on operator input received through the input devices 134 of the user interface 130.

Figure 4:
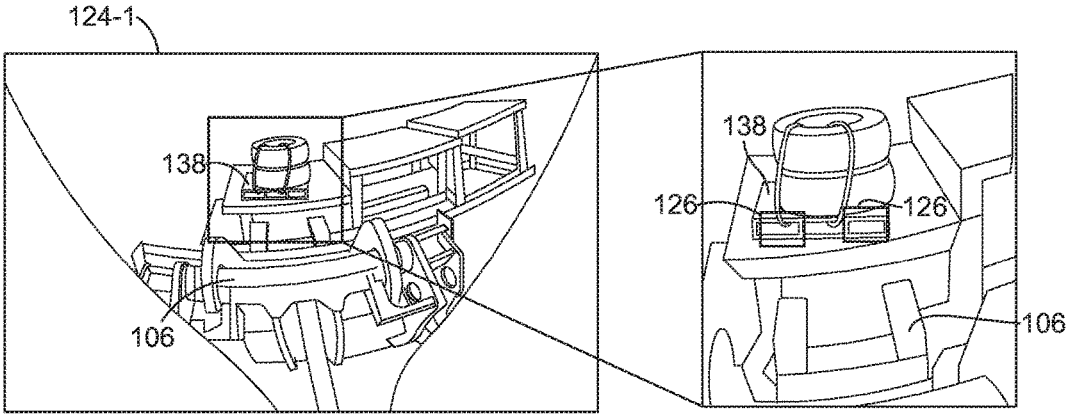
FIG. 4 is a pictorial illustration of interactive targets identified within the first captured image of FIG. 3.
Figure 5:
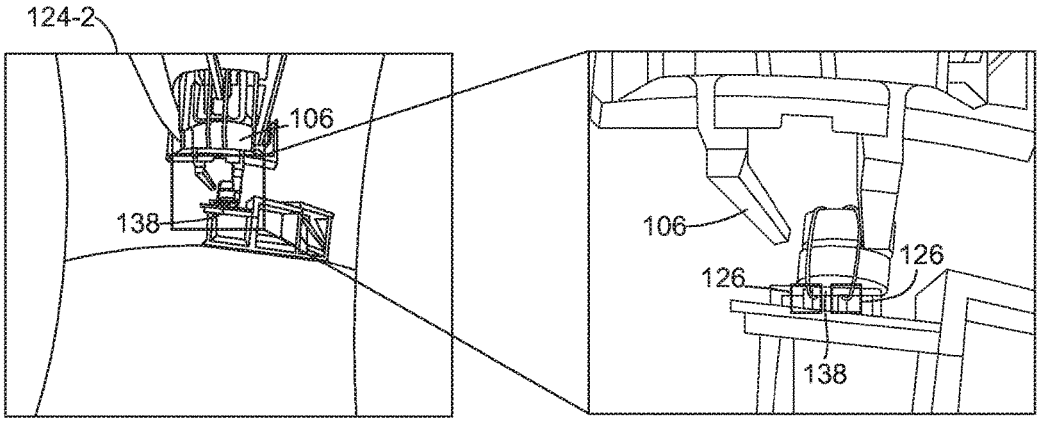
FIG. 5 is a pictorial illustration of interactive targets identified within the second captured image of FIG. 3.

Additionally or optionally, the implement control system 118 of FIG. 2 may include one or more databases 136 which store reference models or other data that enable or facilitate the image-based recognition performed by the implement controller 122. For instance, the database 136 may include preprogrammed data which help the controller 122 automatically recognize and identify commonly used interactive targets 126 from within the captured images 124. Furthermore, different categories of databases 136 may be accessed for different applications. As shown in FIGS. 3-5, for example, for forklift tasks or applications in which a fork tool or implement 106 is used, the controller 122 may access a database 136 that has been programmed with visual cues related to pallets 138, the lift or access points thereof, or the like. As further shown in the captured image 124-3 of FIG. 6, for earthmoving or related applications in which a bucket implement 106 is used, the controller 122 may access a database 136 that has been programmed with visual cues related to sections or accumulations of terrain or other material 140 to be loaded or moved.

While only tasks or applications related to fork and bucket implements 106 are disclosed, it will be understood that other types of implements 106 may also be employed. For instance, the implement controller 122 may identify interactive targets 126 other than those shown in FIGS. 4-6 in other types of applications. Still further, the implement control system 118 may initially undergo a learning stage, within which one or more libraries of reference models or data may be generated and maintained in the databases 136. The reference models or data may provide digital templates, each corresponding to different types of interactive targets 126 or graphical representations thereof. Using the templates as references, the controller 122 may be able to learn the features to look for within a captured image 124. The controller 122 may confirm presence of an interactive target 126 when there is a substantial match between the digital template and the graphical patterns within a captured image 124. Other learning techniques or processes may similarly be used to enable image-based recognition of the interactive targets 126.

Figure 6:
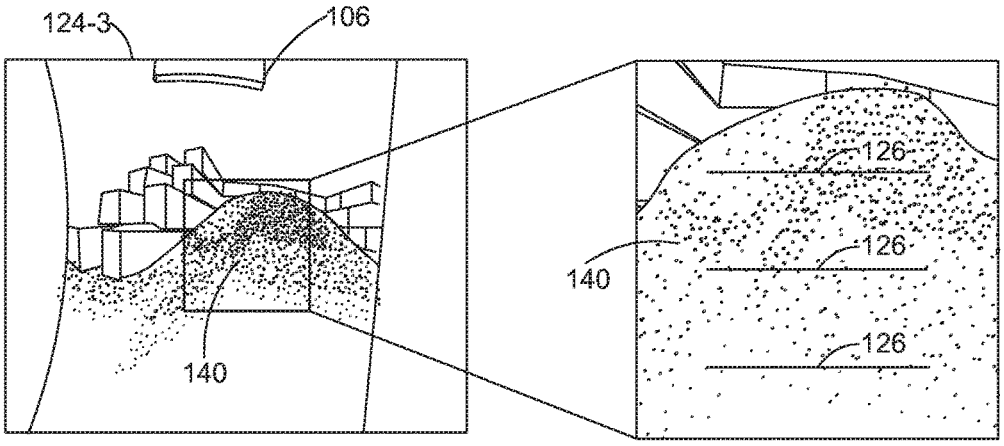
FIG. 6 is a pictorial illustration of another exemplary image captured by image sensors and interactive targets identified by the present disclosure.
Figure 7:
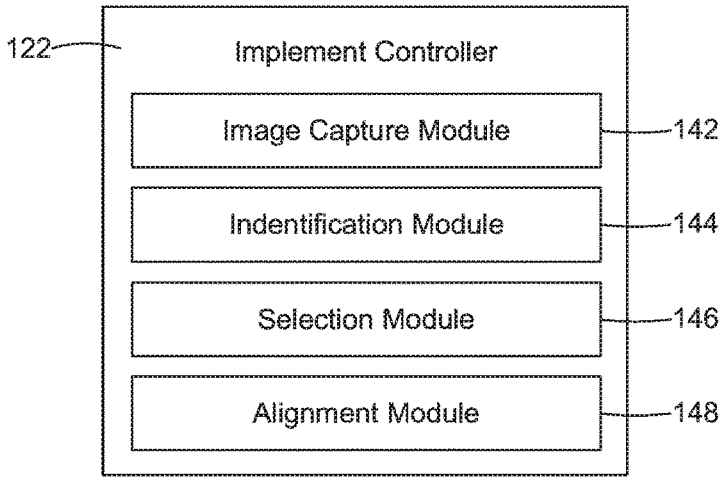
FIG. 7 is a diagrammatic view of one exemplary embodiment of an implement controller of the present disclosure.

Turning to now FIG. 7, the controller 122 of the implement control system 118 may be preprogrammed to operate according to one or more algorithms, or sets of logic instructions or code, which may generally be categorized into, for example, an image capture module 142, identification module 144, selection module 146, and an alignment module 148. Although only one possible arrangement for programming the controller 122 is shown, it will be understood that other arrangements or categorizations of instructions or code can be similarly implemented to provide comparable results. According to the specific embodiment shown in FIG. 7, the image capture module 142 may configure the controller 122 to receive images 124 of a field of view associated with the implement 106 from one or more image sensors 120 as shown for example in FIGS. 3-6. While other variations are possible, the image sensors 120 may transmit the captured images 124 in digital form via a plurality of still photos or frames of video. The images 124 may also be captured in two-dimensional or three-dimensional format.

Furthermore, the controller 122 of FIG. 7 may be configured to receive captured images 124 from various fields of view associated with the implement 106. As shown in FIG. 1 for instance, a first image sensor 120-1 that is mounted at a first height relative to the work machine 100 may be configured to capture a first field of view, and a second image sensor 120-2 that is mounted at a second height relative to the work machine 100 may be configured to capture a second field of view, where each field of view at least partially coincides with a range of motion of the implement 106. Additionally, the identification module 144 of FIG. 7 may configure the controller 122 to identify one or more interactive targets 126 that may exist within the captured images 124. As indicated above, this may be accomplished in a number of different ways, such as via visual or image-based recognition techniques and comparisons to reference models or data preprogrammed in databases 136, or the like. Optionally, the identification module 144 may also employ similar image-based processing to track the position of the implement 106 relative to the interactive targets 126.

Once the interactive targets 126 are identified, the selection module 146 of FIG. 7 may configure the controller 122 to select one of the interactive targets 126 based on proximity. For instance, the selection module 146 may track the position of the work machine 100 via any of the machine sensors 114, and/or track the position of the implement 106 via any of the implement sensors 116, and use the tracked information to gauge proximity between the implement 106 and the interactive targets 126. Based on feedback from the machine sensors 114, the implement sensors 116, and/or the image sensors 120, the selection module 146 may identify or select one of the interactive targets 126 to use as a reference point for alignment purposes. In particular, the selection module 146 may select the interactive target 126 that provides for the most efficient alignment path with the implement 106. For instance, the selection module 146 may be configured to select the interactive target 126 that is situated closest to the implement 106, or use some other criteria for selecting the interactive target 126.

Having identified and selected the relevant interactive targets 126, the alignment module 148 in FIG. 7 may configure the controller 122 to automatically align the implement 106 and the work machine 100 to the interactive targets 126. In the application of FIGS. 4 and 5, for instance, the fork implement 106 may be aligned to the marked interactive targets 126 of the pallet 138 shown. Specifically, the fork implement 106 may be adjusted in terms of speed, position and/or orientation until the fork implement 106 substantially engages the pallet 138, or at least until the fork implement 106 is aligned with the lift or access points of the pallet 138. In the application of FIG. 6, for instance, the bucket implement 106 may be aligned to the marked interactive targets 126 corresponding to sections of terrain or material 140 to be loaded. Specifically, the bucket implement 106 may be adjusted in terms of speed, position and/or orientation until the bucket implement 106 loads the material 140, or at least until the bucket implement 106 is sufficiently aligned and ready to cut into the material 140.

Still referring to FIG. 7, the controller 122 may execute the alignment process in one of various ways, such as via fully autonomous operations, semi-autonomous operations, or substantially manual operations. In fully autonomous operations, the controller 122 may monitor machine speed, implement speed, and other tracked feedback via the machine sensors 114, the implement sensors 116, image sensors 120, and the like, and autonomously control the implement 106 and/or the work machine 100 based on the tracked feedback. With reference to preprogrammed control algorithms for instance, the controller 122 may automatically adjust the speed, height, position, location, direction, and any other parameter of the implement 106 and/or the work machine 100 based on changes in the feedback received. Similarly, semi-autonomous operations may fully automate some of the controls of the implement 106, while leaving other controls in the hands of the operator.

The alignment performed by the controller 122 of FIG. 7 may also be used in conjunction with manual modes of operation. For instance, the operator may retain full manual control of the implement 106 and the work machine 100, until the manual controls begin to stray from an optimal predefined alignment path. When this occurs, the controller 122 may generate automated pulses, haptic feedback, audible alerts, visual indices via the user interface 130, or the like, to redirect the operator. In other modifications, the captured images 124, such as those shown in FIGS. 3-6, may be displayed on a screen or other output device 132 of the user interface 130 to further assist the operator in aligning the implement 106 to the interactive targets 126. In further modifications, the captured images 124 displayed may also provide visual indices corresponding to the identified or selected interactive targets 126 as well as the projected alignment paths thereto. Moreover, the images 124 displayed may be updated substantially in real-time, or with otherwise sufficient frequency to guide the operator during the alignment process.

INDUSTRIAL APPLICABILITY

In general, the present disclosure sets forth methods, devices and systems for mining, excavations, construction or other material moving operations, which may be applicable to wheel loaders, excavators, dozers, motor graders, wheel tractor scrapers, and other off-highway work machines with tools or implements for performing tasks within a worksite. Moreover, the present disclosure enables tracking of working machines and implements within a worksite, and visual or image-based recognition of target objects in the vicinity of the implement to assist the operator in using the implement to perform a given task. In particular, the present disclosure strategically mounts image sensors on the work machine above and/or beneath the implement to capture views of the implement that are otherwise unavailable from within the operator cab. The present disclosure is also capable of identifying interactive targets within the captured images, and automatically aligning the implement to select interactive targets.

Figure 8:
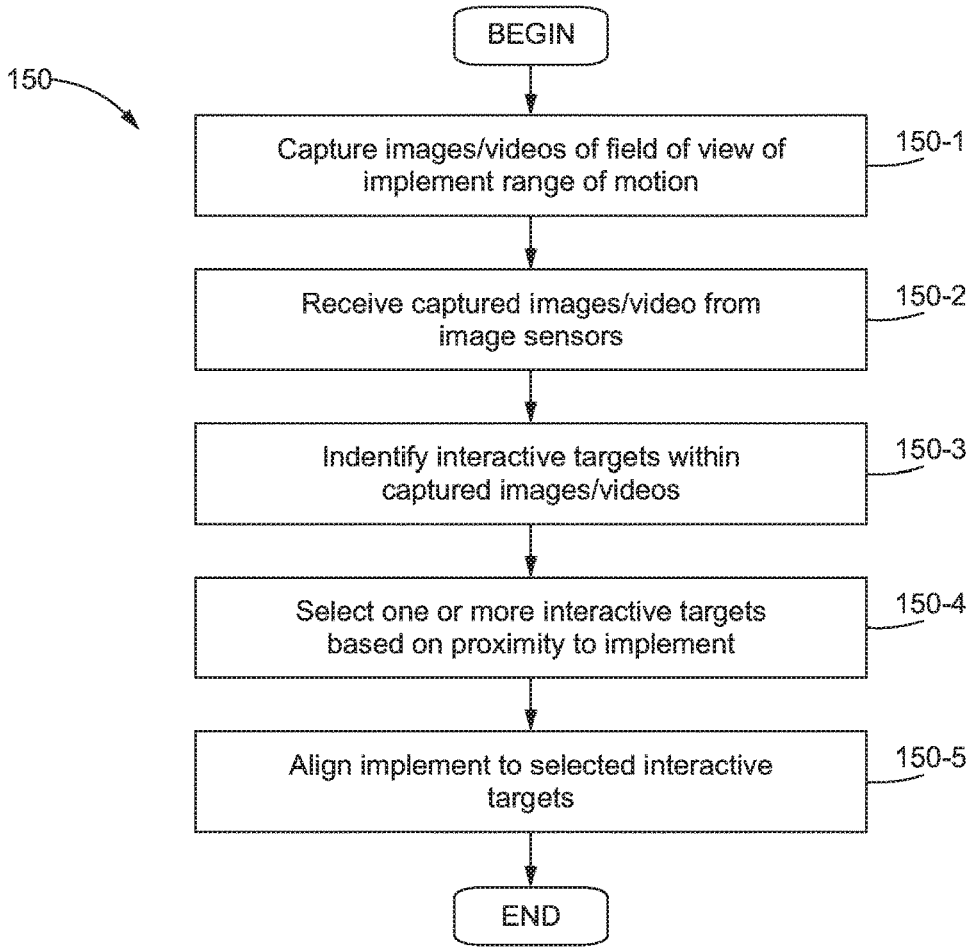
FIG. 8 is a flow diagram of one exemplary method of monitoring an implement of a work machine of the present disclosure.

Turning now to FIG. 8, one exemplary method 150 of monitoring an implement 106 of a work machine 100 is diagrammatically provided. As shown, the method 150 in block 150-1 may initially be configured to capture one or more images 124 of a field of view associated with the implement 106, or overlapping with some range of motion of the implement 106. The images 124 may be captured using one or more image sensors 120 as disclosed in FIG. 1. For example, the method 150 may employ a first image sensor 120-1 that is mounted at a first height relative to the work machine 100 and configured to capture a first field of view of the implement 106, and a second image sensor 120-2 that is mounted at a second height relative to the work machine 100 and configured to capture a second field of view of the implement 106. Moreover, both of the first field of view and the second field of view may be configured to capture the same range of motion of the implement 106 although from different viewpoints.

According to FIG. 8, the method 150 in block 150-2 may be configured to receive the images 124 from the image sensors 120. The images 124 may be received in any variety of formats, such as in discrete photos or images, in a stream of video frames, in two-dimensional image formats, in three-dimensional image formats, and the like. The method 150 in block 150-3 may additionally be configured to identify one or more interactive targets 126 within the images 124. For instance, the interactive targets 126 may be identified based on visual or image-based recognition techniques and with reference to predefined models or data. The method 150 in block 150-4 may further be configured to select one or more of the interactive targets 126 based on proximity. For example, among the interactive targets 126 identified in block 150-3, the method 150 in block 150-4 may select the interactive target 126 that is situated nearest to the implement 106, or any other interactive target 126 that may qualify as a valid reference point for alignment purposes.

Additionally or optionally, the method 150 in FIG. 8 may further track machine position using one or more machine sensors 114 and/or track implement position using one or more implement sensors 116. More specifically, the machine position and the implement position may be used in selecting the interactive target 126 in block 150-4. Still further, the method 150 in block 150-5 may be configured to automatically align the implement 106 to the selected interactive target 126. As discussed above with respect to FIG. 7 for instance, the implement 106 may be adjusted in terms of speed, position and/or orientation until the implement 106 substantially engages or at least aligns with the selected interactive target 126. The method 150 may also be configured to monitor machine speed, and control the implement speed based on the machine speed while aligning the implement 106. The method 150 may additionally execute the alignment process in one of various ways, such as via fully autonomous operations, semi-autonomous operations, or manual operations.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A system for monitoring an implement of a work machine, the system comprising:

one or more image sensors mounted on the work machine configured to capture one or more images of a field of view associated with the implement; and an implement controller in electrical communication with the image sensors, the implement controller configured to receive the images from the image sensors, identify one or more interactive targets within the images, select one of the interactive targets based on proximity, and align the implement to the selected interactive target.

2. The system of claim 1, wherein the image sensors are configured to capture the images in at least one of a two-dimensional format or a three-dimensional format.

3. The system of claim 1, wherein the image sensors are mounted such that the field of view at least partially coincides with a range of motion of the implement.

4. The system of claim 1, wherein the image sensors include a first image sensor that is mounted at a first height relative to the work machine and configured to capture a first field of view, and a second image sensor that is mounted at a second height relative to the work machine and configured to capture a second field of view, each of the first field of view and the second field of view at least partially coinciding with a range of motion of the implement.

5. The system of claim 1, wherein the controller is configured to identify the interactive targets based on visual recognition and predefined reference data.

6. The system of claim 1, further comprising one or more machine sensors configured to track machine position, and one or more implement sensors configured to track implement position, the controller being configured to select the interactive target closest to the implement based on feedback from one or more of the machine sensors, the implement sensors, or the image sensors.

7. The system of claim 1, wherein the controller is configured to monitor a machine speed, and control an implement speed based on the machine speed while aligning the implement.

8. A work machine, comprising:

a machine frame supported by traction devices;

an operator cab coupled to the machine frame;

an implement movably coupled to the operator cab;

a plurality of image sensors mounted on the operator cab work machine configured to capture one or more images of a field of view associated with the implement; and a controller in electrical communication with the plurality of image sensors and the implement, the controller configured to receive the images from the plurality of image sensors, identify one or more interactive targets within the images, select one of the interactive targets based on proximity, and align the implement to the selected interactive target.

9. The work machine of claim 8, wherein the plurality of image sensors includes a first image sensor that is mounted on the operator cab and configured to capture a first field of view from a first height, and a second image sensor that is mounted on the machine frame and configured to capture a second field of view from a second height, each of the first field of view and the second field of view at least partially coinciding with a range of motion of the implement.

10. The work machine of claim 8, wherein the controller is configured to identify the interactive targets based on visual recognition and predefined reference data.

11. The work machine of claim 8, wherein the controller is configured to monitor a machine speed, and control an implement speed based on the machine speed while aligning the implement.

12. The work machine of claim 8, further comprising one or more machine sensors coupled to the machine frame and configured to track a machine position, and one or more implement sensors coupled to the implement and configured to track an implement position, the controller being configured to select the interactive target closest to the implement based on feedback from one or more of the machine sensors, the implement sensors, or the image sensors.

13. The work machine of claim 8, further comprising a display device disposed within the operator cab that is in electrical communication with the image sensors and configured to display the captured images.

14. A method of monitoring an implement of a work machine, the method comprising:

capturing one or more images of a field of view associated with the implement from one or more image sensors, wherein the images are of the machine's surroundings;

receiving the images from the image sensors;

identifying one or more interactive targets within the images of the machine's surroundings;

selecting one of the interactive targets based on proximity; and aligning the implement to the selected interactive target.

15. The method of claim 14, wherein the images are captured in at least one of a two-dimensional format or a three-dimensional format, and the field of view at least partially coincides with a range of motion of the implement.

16. The method of claim 14, wherein the image sensors include a first image sensor that is mounted at a first height relative to the work machine and configured to capture a first field of view, and a second image sensor that is mounted at a second height relative to the work machine and configured to capture a second field of view, each of the first field of view and the second field of view at least partially coinciding with a range of motion of the implement.

17. The method of claim 14, wherein the interactive targets are identified based on visual recognition and predefined reference data.

18. The method of claim 14, further tracking a machine position using one or more machine sensors, and tracking an implement position using one or more implement sensors.

19. The method of claim 18, wherein the interactive target closest to the implement is selected based on feedback from one or more of the machine sensors, the implement sensors, or the image sensors.

20. The method of claim 14, further including monitoring a machine speed, and controlling an implement speed based on the machine speed while aligning the implement.

* * * * *